US007862226B2

(12) United States Patent
Bracher et al.

(10) Patent No.: US 7,862,226 B2
(45) Date of Patent: Jan. 4, 2011

(54) WATCH WITH A FUNCTION INDICATOR

(75) Inventors: Christian Bracher, Albligen (CH); Raphaël Courvoisier, Peseux (CH)

(73) Assignee: ETA SA Manufacture Horlogère Suisse, Marin (CH)

( * ) Notice: Subject to any disclaimer, the term of this patent is extended or adjusted under 35 U.S.C. 154(b) by 280 days.

(21) Appl. No.: 12/199,105

(22) Filed: Aug. 27, 2008

(65) Prior Publication Data

US 2009/0059732 A1 Mar. 5, 2009

(30) Foreign Application Priority Data

Aug. 30, 2007 (EP) ..... 07115258

(51) Int. Cl.
*G04B 27/02* (2006.01)
*G04B 27/00* (2006.01)

(52) U.S. Cl. ..... 368/190; 368/34; 368/194

(58) Field of Classification Search ..... 368/28, 368/34–37, 190–195
See application file for complete search history.

(56) References Cited

U.S. PATENT DOCUMENTS

| | | | | |
|---|---|---|---|---|
| 3,702,530 | A * | 11/1972 | Besson et al. | 368/35 |
| 4,232,510 | A * | 11/1980 | Tamaru et al. | 368/28 |
| 4,422,775 | A * | 12/1983 | Thoenig | 368/74 |
| 5,646,914 | A | 7/1997 | Blunschi et al. | |
| 6,490,230 | B1 * | 12/2002 | Sakuyama et al. | 368/11 |

FOREIGN PATENT DOCUMENTS

| | | |
|---|---|---|
| CH | 289763 | 7/1953 |
| CH | 534381 | 4/1973 |
| EP | 730 758 | 9/1996 |
| EP | 0 836 125 | 9/1997 |
| WO | 96/09572 | 3/1996 |

OTHER PUBLICATIONS

"Calibre RM008" as described on the website www.worldtempus.com, printed Aug. 26, 2008.
European Search Report issued in corresponding application No. 07 11 5258, completed May 16, 2008.

* cited by examiner

*Primary Examiner*—Vit W Miska
(74) *Attorney, Agent, or Firm*—Griffin & Szipl, P.C.

(57) ABSTRACT

The dial (4) of the watch is fitted with an indicator (10), preferably with a hand (11), which displays the function fulfilled by a control crown (8), respectively, in each axial position of the crown, including a highly water resistant position in the case of a screwed-in crown. The indicator is controlled by axial movements of a sleeve (15) secured to the crown, via a transmission mechanism (30) including a slide block (35) that is mobile parallel to an axis of rotation (14) of the crown. The hand is secured to a pinion (32) meshed with a rack (34) arranged on a slide block. The slide block includes a flexible part (38) between a back part that slides in a groove (36), and a front arm (39) provided with a lateral finger (40) engaged in an annular groove of the sleeve. This transmission is compact and facilitates assembly and removal.

8 Claims, 3 Drawing Sheets

WATCH WITH A FUNCTION INDICATOR

This application claims priority from European Patent Application No. 07115258.1, filed Aug. 30, 2007, the entire disclosure of which is incorporated herein by reference.

BACKGROUND OF THE INVENTION

The present invention concerns a watch provided with a case that contains a watch movement, a dial and a function indicator associated with the dial, and a control crown arranged on the periphery of the case and having an axis of rotation substantially parallel to the dial, said crown being able to slide in the axial direction thereof to be set in axial positions corresponding to various functions of the watch, the function indicator being controlled by the axial movements of the crown via a transmission mechanism.

These function indicators have already been provided, either so that the wearer of the watch does not choose the wrong function if the crown controls several functions, or to indicate that a "screwed" in crown is actually in its screwed in position, i.e. a position that seals the watchcase in a reinforced manner at the control stem, by compressing a sealing gasket under the crown.

The first aforementioned type is illustrated in particular in CH Patent No. 534 381 in accordance with which the control stem cooperates, in a first position, with a rotating selector that causes a pinion of the stem to mesh with one of the correction mechanisms that can be actuated by the stem when the latter is set in its second position. The selector carries function symbols, which appear in turn in an aperture of the dial. This system has a complicated structure, making it difficult to mount the movement in the case and remove it therefrom. Moreover, several manipulations are always needed to carry out each function, since the selector must be returned to a neutral position after use. EP Patent No. 836 125 provides, for an electronic watch with an alarm, that the alarm control is switched on by means of a lever which is controlled by the axial movement of the stem and fulfills a dual role: electric switch for the alarm function and actuating lever for a visual hand indicator on the dial. This type of indicator evidently has only two positions.

A Richard Mille watch called Calibre RM008, mentioned on the website Worldtempus.com among the new releases for 2004, included a function indicator with three positions corresponding to the positions of the control crown, including one water-resistant position. However, the Applicant does not know of any description of this particular device. The description of a function indicator especially associated with a screwed in crown can be found in EP Patent No. 730 758. It is known that a screwed in type crown is generally not fixed directly to the control stem, but to a sleeve surrounding the stem and cooperating therewith by means of a coupling that allows some axial play when the crown is being screwed in, to prevent the stem being pushed in too far. The aforecited Patent provides, on the inner end of this sleeve, a drive finger, which, at the end of the sleeve's travel, rotates a toothed wheel meshed in apertures of a slide block placed under the periphery of the dial. One end of the slide block appears in an aperture in the dial as the screwing in of the crown ends. The advantage of this indicator is limited, since it can only indicate one function. The screwed in crown of a mechanical watch has at least three functions (screwed in, winding, time-setting) and often a fourth for correcting a calendar or other complication.

Further, watches having a selector have been proposed for selecting the functions to be carried out by the crown or by a multi-functional push-button, the selector naturally being provided with a function indicator. This requires two distinct control members, each penetrating the watchcase, which is evidently not the case of the invention presented here.

SUMMARY OF THE INVENTION

It is an object of the present invention to overcome the drawbacks of the prior art by providing a device capable of indicating the different functions corresponding to the different axial positions of the control crown, in particular at least three positions, with a very simple and compact construction inside the watchcase. The device must be able to be made as an additional mechanism for a standard movement. An additional object is that the device can be easily mounted and removed.

There is therefore provided a watch as defined in claim 1.

Owing to these features, the axial movements of the crown are transmitted to the function indicator by a simple slide block whose arrangement and movements are parallel to the control stem of the movement, and thus occupy much less space than the lever or gear mechanisms of the prior art. Moreover, the slide block can be thin enough to be housed in a shallow groove, milled into the thickness of the plate of the watch movement, and can thus extend to the desired position of the function indicator.

Other features and advantages of the invention will appear more clearly in the following description of a particular embodiment, given solely by way of example and illustrated by the annexed drawings.

DETAILED DESCRIPTION OF ONE EMBODIMENT

Figure 1:
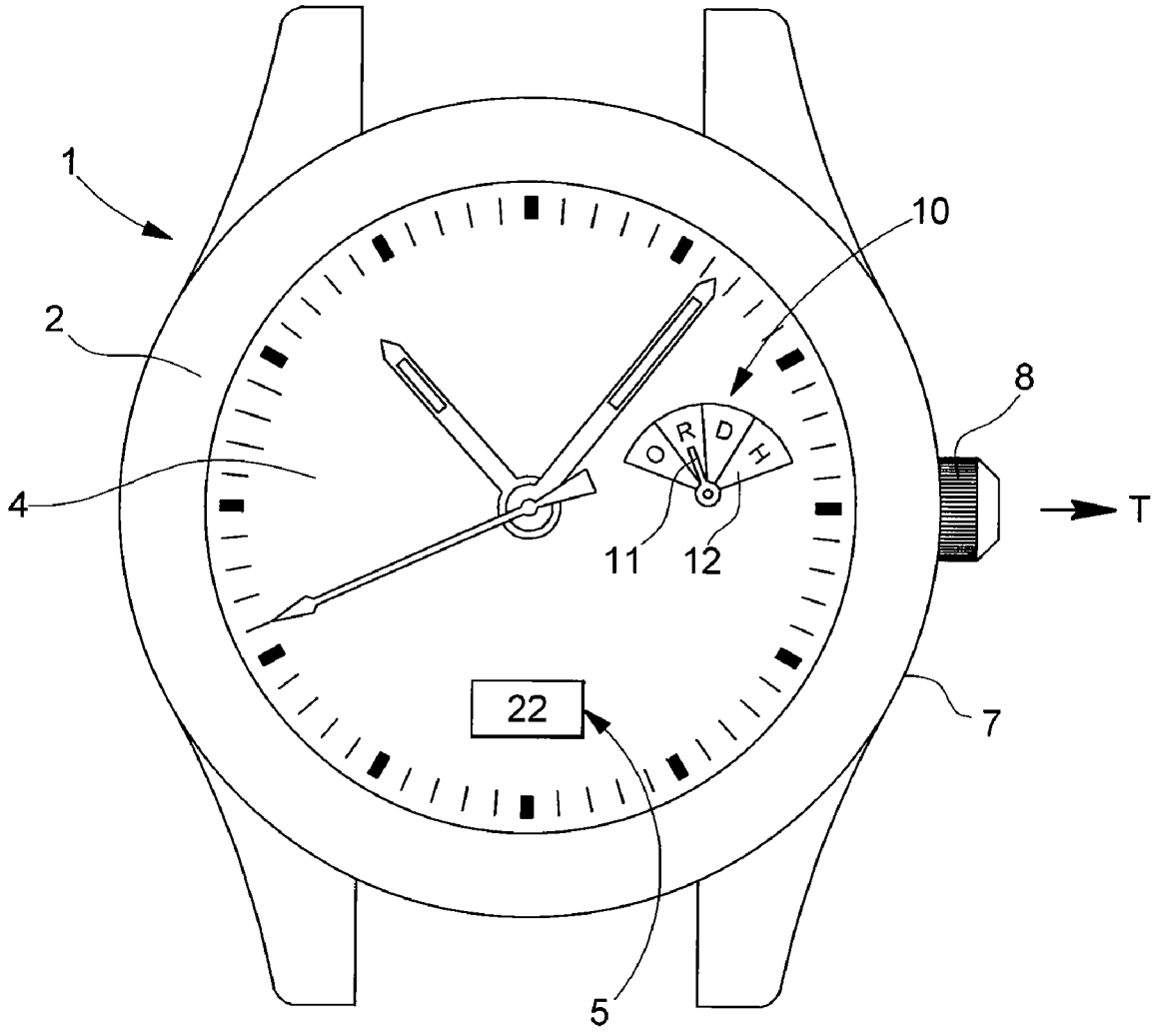
FIG. 1 is a schematic frontal view of a wristwatch provided with a screwed in crown and a function indicator according to the invention.

Wristwatch 1 shown in the FIG. 1 includes, in a conventional manner, a water-resistant case 2 containing a watch movement, a time display using hands above a dial 4, and a date display 5, in this case the day of the month, in an aperture in the dial or in another manner. The movement is mechanical in this case, but it could equally be electromechanical with the same embodiment of the invention. The date display could also include an indication of the day of the week, month, etc. and could be electrical in other cases. As usual, the movement is provided with a control stem 6 (FIG. 2) that rotates and slides, and which passes through middle part 7 of case 1 in a water-resistant manner and which carries at its outer end a crown 8, which, in this example, is of the screwed-in crown type.

As was mentioned above, the screwed in crown of a calendar watch can usually occupy four distinct axial positions: screwed-in, winding (or neutral if the movement is electromechanical), date-setting, and time-setting. With the present invention, the watch has a visual mechanical indicator 10 that constantly indicates which of these positions crown 8 is in, and thus the respective functions that crown 8 can fulfil when it is set in these positions. In order to clarify the information that it provides, this indicator is arranged on dial 4 in proximity to crown 8, more specifically between the crown and the centre of the dial. In the embodiment shown in the drawings, indicator 10 has a hand 11 connected to crown 8 via a mechanical transmission so as to pivot in front of a sector based field 12 drawn on dial 4. Field 12 is divided into four sectors that correspond to the four positions of the crown and bear symbols representing the corresponding functions, for example: a coloured dot O for the screwed-in water-resistant position, R for winding, or the neutral position, D for date-setting, H for time-setting. In order to facilitate manipulation of the crown by the user, these symbols are arranged (from left to right in the drawing) in the same order as the corresponding positions of the crown. Thus, it is clear that to correct the time, crown 8 must be pulled out in the direction of arrow T to the last position, corresponding to indication H.

Figure 2:
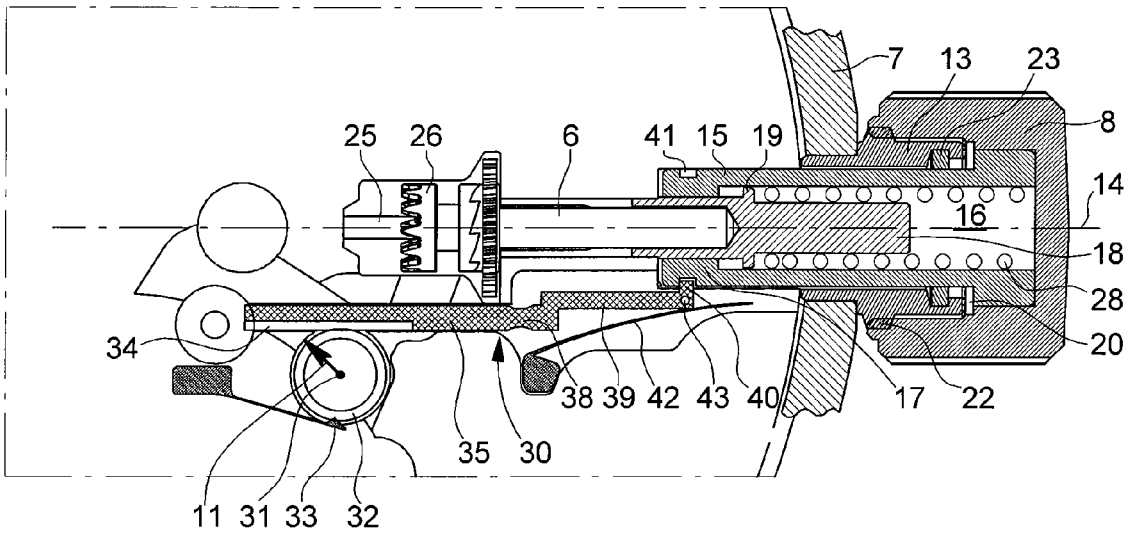
FIG. 2 is a schematic partial cross-section of the control crown of the watch of FIG. 1 in the screwed in position, also showing the transmission mechanism that connects this crown to the function indicator.

FIG. 2 shows a known screwed-in crown construction, shown here in the screwed-in position. A tube 13 fixed in a hole in middle part 7 projects outside the watchcase and contains a rotating sleeve 15, which is welded inside crown 8 and which can slide along the axis 14 of the tube and the crown. Sleeve 15 has a central channel 16 of polygonal section, with an inner edge 17 at the front and in which a stem-carrier 18 can slide axially within certain limits, but remains connected to the sleeve and to the crown in rotation, owing to a polygonal collar 19. The stem-carrier 18 is screwed onto the end of control stem 6 of the watch movement. Crown 8 contains an annular sealing gasket 20 and includes an inner thread which screws onto an outer thread 22 of tube 13 until sealing gasket 20 is highly compressed between the crown and the tube to guarantee a high level of water resistance. When the crown is unscrewed, another sealing gasket 23 provides an ordinary seal between tube 13 and sleeve 15.

Stem 6 is of conventional construction, with a square section 25 bearing a sliding pinion 26 whose position is controlled in a known manner from a pull-out piece (not shown). This device may include notches that define the three axial positions of stem 6. By comparing FIG. 2 to FIG. 3, it can be seen that when crown 8 is screwed onto tube 13, stem 6 does not move while sleeve 15 advances, such that the inner edge 17 of the sleeve moves away from collar 19 of stem-carrier 18. Conversely, in the other positions of the crown, in accordance with FIGS. 3 to 5, collar 19 is held abutting against edge 17 by a compression spring 28, such that stem 6 follows the axial movements of crown 8 in both directions, and the rotational movements.

The mechanical transmission 30 connecting crown 8 to hand 11 of the function indicator 10 is visible in detail in FIG. 2. An arbour 31 connects hand 11 to a pinion 32 located behind dial 4 and stopped in discrete positions by a jumper spring 33. Pinion 32 is meshed on a rack 34 arranged on one side of the back part of a flat slide block 35, this part 37 being guided in a groove 36 arranged in the normal thickness of the plate of the movement. Close to the end of groove 36, the slide block has a constricted part 38 and it is continued by an arm 39 ending in a lateral finger 40. The latter is held engaged in an annular groove 41 surrounding the proximal end of sleeve 15, via the effect of a spring 42, such that slide block 35 accompanies all the axial movements of sleeve 15 and crown 8. A bevel is arranged both on the end of sleeve 15 and on the end of finger 40 in order to facilitate assembly thereof by using the flexibility of constricted part 38. A hole 43 in the finger allows a tip to be inserted to move finger 40 away in order to remove transmission 30 or crown 8.

Mechanical transmission 30, essentially formed of flat parts 32 and 35 parallel to the plate of the movement, has a small thickness and can be housed largely in shallows recesses—called "spot facings"—in the plate, while being held by a single bridge. The plane of transmission 30 is also compact, given that the slide block is narrow and that it moves longitudinally inside its groove. The slide block thus sweeps a minimum space as it moves. Thus, it is possible to incorporate the slide block in a standard calibre by only slightly modifying the latter.

With transmission 30, each axial movement of crown 8 rotates pinion 32 and hand 11 proportionally to the movement amplitude, such that the four operating positions of the crown correspond to defined positions of hand 11 in front of the four respective sectors O, R, D and H of indicator 10.

In the screwed in position shown in FIG. 2, hand 11 is in front of sector O and indicates that the sealing function of the crown is being properly performed.

Figure 3:
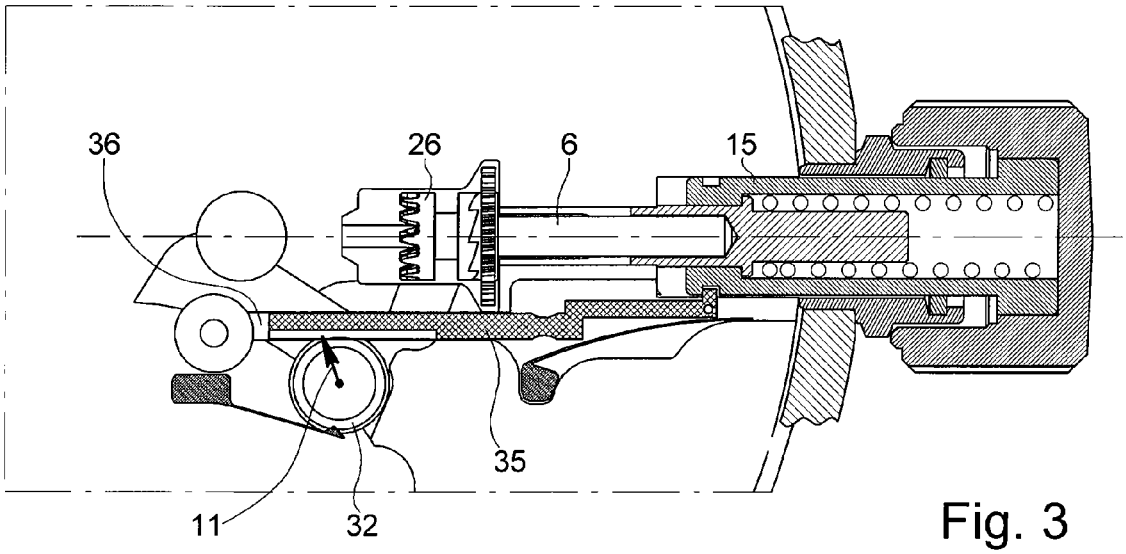
FIGS. 3 to 5 show three other positions of said mechanism for three axial operating positions of the crown.

When the user unscrews crown 8 until it is released from thread 22, spring 28 causes the crown and sleeve 15 to move back until edge 17 of the sleeve is stopped as shown in FIG. 3, by collar 19 of stem-carrier 18 which has not moved axially. This position of the sleeve places hand 11 in front of sector R of indicator 10, indicating that the crown is ready to be rotated to wind the movement.

Figure 4:
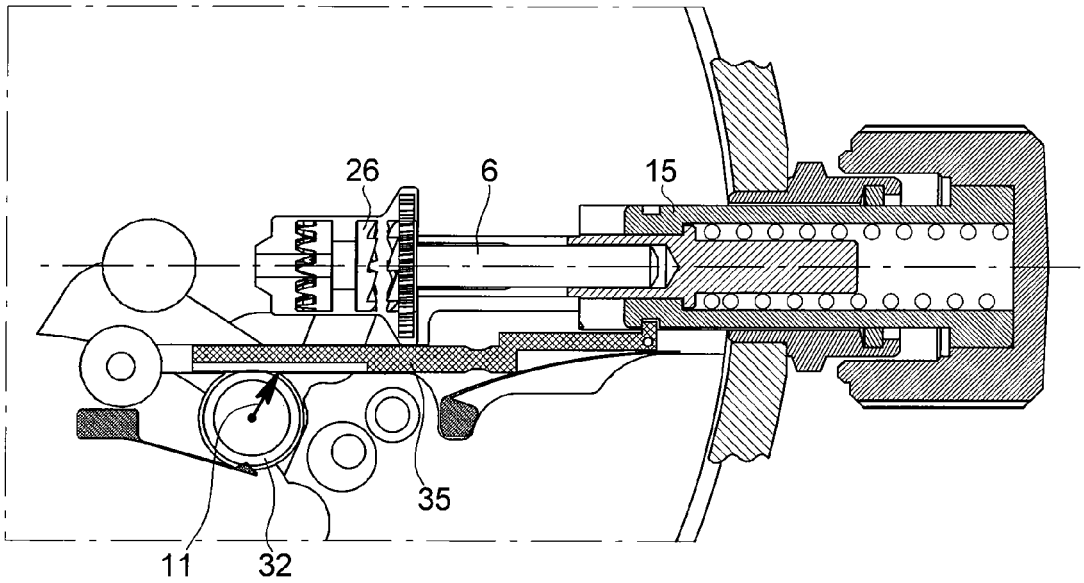

If the user then pulls out crown 8 in the direction of arrow T to the first pulled out position of stem 6, as seen in FIG. 4, the axial movement of sleeve 15 places hand 11 in front of sector D of indicator 10, indicating that the crown is ready to be rotated to correct date indicator 5.

Figure 5:
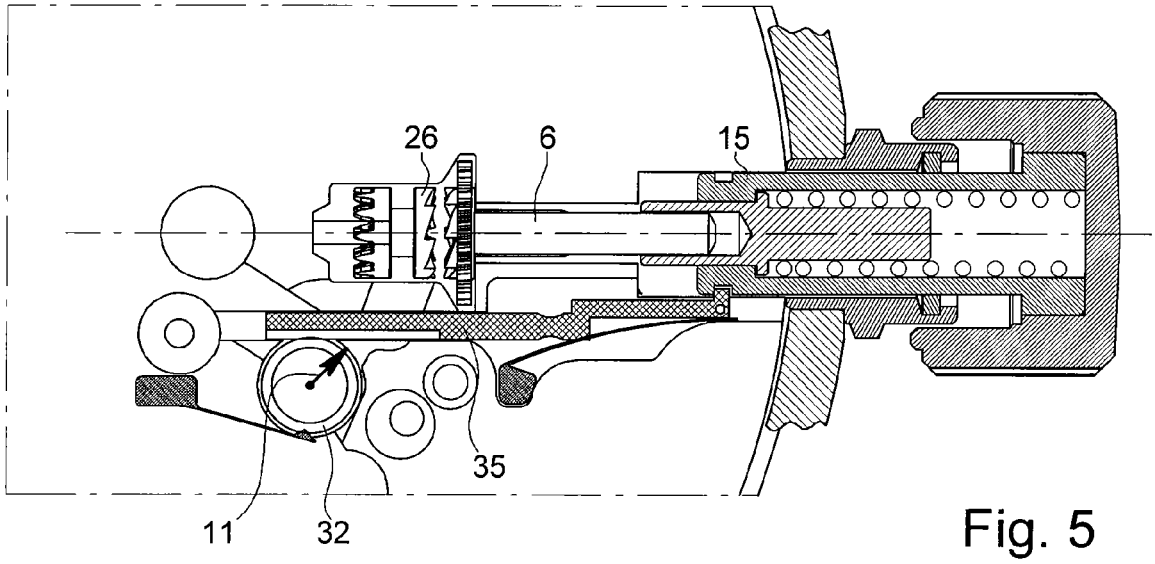

If the user pulls the crown again to the second pulled out position of stem 6, as shown in FIG. 5, the axial movement of sleeve 15 places hand 11 in front of sector H of indicator 10, indicating that the crown is ready to be rotated to correct the time displayed by the hands. When crown 8 is pushed back in the direction of case 2, this axial movement returns hand 11 to sector R, screwing in the crown then gradually returns the hand to sector O.

During these manoeuvres, the explicit indication of the function that will be fulfilled by rotating the crown in the current axial position facilitates adjustment of the watch, since the user does not need to rotate the crown to check whether the stem has been pulled out by one notch or two. This therefore prevents an inadvertent change of the time or date, as commonly happens with a usual watch when the crown is not in the position that one believes it to be in.

In a variant that is not shown, the rotating elements 11, 31 an 32 could be omitted and the function indicator could be formed by symbols such as O, R, D and H carried by slide block 35 and appearing in an aperture in dial 4. However, indication by a hand better displays the gradual arrival at the screwed in position.

In a watch with a crown that is not screwed in, sleeve 15 generally does not exist and the crown is fixed to the end of the control stem. A groove equivalent to groove 41 could be arranged on the stem for receiving finger 40 of the slide block of the device according to the invention. The axial position indicated will in fact be that of the stem, but the construction of the transmission and the indicator could remain unchanged.

The preceding description and the drawings show that the present invention enables a crown function indicator to be made in a very simple and compact manner. Unlike the selector devices mentioned in the introduction, the device of the invention keeps the usual control stem, which greatly simplifies the mechanism. Moreover, the slide block transmission parallel to the stem can indicate any number of axial positions and is extremely easy to assemble and remove.

What is claimed is:

1. A watch provided with a case that contains a watch movement, a dial and a function indicator associated with the dial, and a control crown arranged on the periphery of the case and having an axis of rotation that is substantially parallel to the dial, said crown being able to slide in the axial direction thereof to be set in axial positions corresponding to different functions, the function indicator being controlled by axial movements of the crown via a transmission mechanism, wherein said transmission mechanism includes a slide block that is mobile parallel to the axis of the crown and has a lateral finger engaged in an annular groove of an element secured to the crown.

2. The watch according to claim 1, wherein the slide block includes a flexible part arranged between a back part that slides in guide means and a front part provided with the lateral finger.

3. The watch according to claim 1, wherein the function indicator includes a pinion meshed with a rack arrange on the slide block.

4. The watch according to claim 3, wherein the function indicator includes a hand connected to said pinion, and function symbols applied to the dial opposite said hand.

5. The watch according to claim 1, wherein the function indicator has at least three positions.

6. The watch according to claim 5, wherein the crown is of the screwed in crown type, said element secured to the crown being a sleeve that can be moved axially relative to the control stem of the movement when the crown is being screwed in or unscrewed.

7. The watch according to claim 1, wherein it includes a date display that can be corrected by rotating the crown placed in an axial date setting position, and wherein the function indicator includes a specific indication corresponding to said axial position of the crown.

8. The watch according to claim 1, wherein the function indicator is located between the crown and the centre of the dial.

* * * * *